US007522057B2

(12) United States Patent
Stern et al.

(10) Patent No.: US 7,522,057 B2
(45) Date of Patent: Apr. 21, 2009

(54) SYSTEM AND METHOD FOR NON INTRUSIVE MONITORING OF "AT-RISK" INDIVIDUALS

(75) Inventors: Edith Stern, Yorktown Heights, NY (US); Barry E. Willner, Briarcliff Manor, NY (US)

(73) Assignee: International Business Machines Corporation, Armonk, NY (US)

( * ) Notice: Subject to any disclaimer, the term of this patent is extended or adjusted under 35 U.S.C. 154(b) by 91 days.

(21) Appl. No.: 11/507,325

(22) Filed: Aug. 21, 2006

(65) Prior Publication Data

US 2007/0069900 A1 Mar. 29, 2007

Related U.S. Application Data

(62) Division of application No. 09/810,015, filed on Mar. 16, 2001, now Pat. No. 7,095,328.

(51) Int. Cl.
*G08B 23/00* (2006.01)

(52) U.S. Cl. ..... 340/573.1; 340/573.4; 340/522; 340/540; 340/541; 340/568.1; 340/666; 600/300; 600/301; 701/213; 701/216

(58) Field of Classification Search ..... 340/573.1, 340/573.4, 522, 540, 541, 568.1, 666; 600/300, 600/301; 701/213, 216
See application file for complete search history.

(56) References Cited

U.S. PATENT DOCUMENTS

| | | | | |
|---|---|---|---|---|
| 5,107,845 | A | 4/1992 | Guern et al. | |
| 5,253,070 | A | 10/1993 | Hong | |
| 5,505,199 | A | 4/1996 | Kim | |
| 6,297,738 | B1 * | 10/2001 | Newham | 340/573.1 |
| 6,504,482 | B1 | 1/2003 | Mori et al. | |
| 6,611,206 | B2 | 8/2003 | Eshelman et al. | |

* cited by examiner

*Primary Examiner*—Tai T Nguyen
(74) *Attorney, Agent, or Firm*—Louis J. Percello; Brian P. Verminski; David Aker

(57) ABSTRACT

Disclosed is a system and method for monitoring one or more humans while maintaining the privacy of those individuals. The system includes one or more activity pickups that create one or more respective information outputs. A computer system monitors one or more of the information outputs and processes the information outputs to determine when one or more types of inactivity of the human in an area exceeds one or more thresholds of inactivity. Alarms and/or indications activate when one or more of the thresholds of inactivity is exceeded. Various types of thresholds of inactivity are disclosed.

9 Claims, 8 Drawing Sheets

SYSTEM AND METHOD FOR NON INTRUSIVE MONITORING OF "AT-RISK" INDIVIDUALS

This application is a divisional application of application Ser. No. 09/810,015 filed on Mar. 16, 2001, which issued as U.S. Pat. No. 7,095,328.

FIELD OF THE INVENTION

This invention relates to surveillance and monitoring systems. More specifically, the invention relates to monitoring "at-risk" individuals.

BACKGROUND OF THE INVENTION

Closed circuit television, and other video surveillance methods are commonly used for crime control. Per http://www.privacy.org/pi/issues/cctv/. 225-450 million dollars "per year is now spent on a surveillance industry involving an estimated 300,000 cameras covering shopping areas, housing estates, car parks and public facilities in great many towns and cities." Systems to enable such surveillance are commonly sold to security services, consumers and over the Internet. http://www.smarthome.com/secvidsur.html for example sells a variety of equipment for video surveillance.

These surveillance systems require active monitoring, and are generally viewed as potential privacy violations. Privacy concerns lead to the posting of surveillance policies in places such as locker rooms and dressing rooms.

In 1997, Defense Advanced Research Projects Agency (DARPA) Information Systems Office began a program to develop Video Surveillance and Monitoring (VSAM) technology. This technology is intended to alert an operator during an event in progress (such as a crime) in time to prevent the crime. The technology triggers an operator to view a video feed and take appropriate action. It does not protect privacy, and is triggered by observed action at one of the points of monitoring. (see http://www.cs.cmu.edu/·vsam/vsamhome-.html).

Another technology in this space is scene change detection. Scene change detection is used in the media industry as an aid to editing and indexing media. It accomplishes just what the name implies. Video is examined for significant differences on a "frame by frame" basis. When the differences meet criteria, a scene change is declared. These are used in the media industry to create storyboards of a video, to create indexes for media manipulation, and as an aid in editing, e.g. for example in creating a nightly news story. Scene change detection is taught by such patents as U.S. Pat. No. 6,101,222 and U.S. Pat. No. 5,099,322. Scene change detection is offered as part of content management systems by Virage (http://www.virage.com), and Bulldog (http://www.bulldog-.com).

Audio change detection, determining where in an audio stream a particular loudness or frequency threshold has been reached can also be used to determine events of interest, such as a score in a football game, or a gunshot. See U.S. Pat. No. 6,163,510 to Lee et al. Medical alert systems, comprising a pendant or other device, worn by the user allow an at-risk individual to signal to a distant system or person that an emergency has occurred. These have been popularized as "I've fallen and I can't get up" devices. Offered by companies such as Responselink, these systems include a wearable portion, power transformer, batteries, phone connection, and a monitoring service. The monitoring service, usually with a monthly fee, responds to alerts submitted by the user. Note that the user must have the ability to press the button and signal the alert for the alert to be sent. Injuries that involve rapid loss of consciousness may prevent the user from such signaling. Responselink information can be found at http://www.responselink.com Periodic phone calls are also used to check on at-risk people. Relatives, friends or a paid service can call the individuals and ascertain from their responses whether or not they are OK.

Face recognition is a technology which can identify faces, and in many cases associate them with names in a database. Visionics (http://www.visionics.com) offers a product called FaceIt which "will automatically locate faces in complex scenes. . . "

All these cited references are herein incorporated by reference in their entirety.

PROBLEMS WITH THE PRIOR ART

Video surveillance is a labor intensive method of surveillance. Images must be reviewed frequently in order to ensure that desired actions/behaviors are occurring. In order to monitor an at-risk individual's apartment, this can entail multiple monitors, one or more in each room or living space, each with its own feed. Personnel to monitor these feeds can be prohibitively expensive. Personnel to monitor these feeds, even if assigned, must either monitor them locally, or the video must be transmitted elsewhere. Bandwidth for such transmission is expensive. What is needed is a way to ensure safety without using large amounts of expensive bandwidth or of expensive personnel to achieve this goal.

The DARPA VSAM project previously referenced seeks to address the manpower required in the military domain, as well as provide continuous 24-hour monitoring of surveillance video to alert security officers to a burglary in progress, or to a suspicious individual loitering in the parking lot, while there is still time to prevent the crime. What is needed for monitoring at risk individuals is the ability to determine whether an overall acceptable amount of activity has taken place over time.

Additionally, such monitoring is an invasion of privacy. Elderly or at risk individuals do not welcome such loss of dignity and privacy. What is needed is a way to ensure their safety without primary surveillance; that is a way to ensure safety without invading privacy.

At risk individuals or elderly individuals may also be mobility impaired. Surveillance techniques can provide a subjective assessment of an individual's viewed mobility. However, surveillance must be constant and continuous to fully assess such activity. In addition to monitoring for safety, what is needed is an objective measurement of the change in voluntary activity over time.

OBJECTS OF THE INVENTION

An object of this invention is an improved system and method for monitoring "at-risk" individuals.

An object of this invention is an improved system and method for monitoring "at-risk" individuals while maintaining respect for their privacy.

SUMMARY OF THE INVENTION

The present invention is a system and method for monitoring one or more humans while maintaining the privacy of those individuals. The system includes one or more activity pickups that create one or more respective information outputs. A computer system monitors one or more of the information outputs and processes the information outputs to determine when one or more types of inactivity of the human in an area exceeds one or more thresholds of inactivity. Alarms and/or indications activate when one or more of the thresholds of inactivity is exceeded. Various types of thresholds of inactivity are disclosed.

BRIEF DESCRIPTION OF THE FIGURES

The foregoing and other objects, aspects, and advantages will be better understood from the following non limiting detailed description of preferred embodiments of the invention with reference to the drawings that include the following.

DETAILED DESCRIPTION OF THE INVENTION

Figure 1:
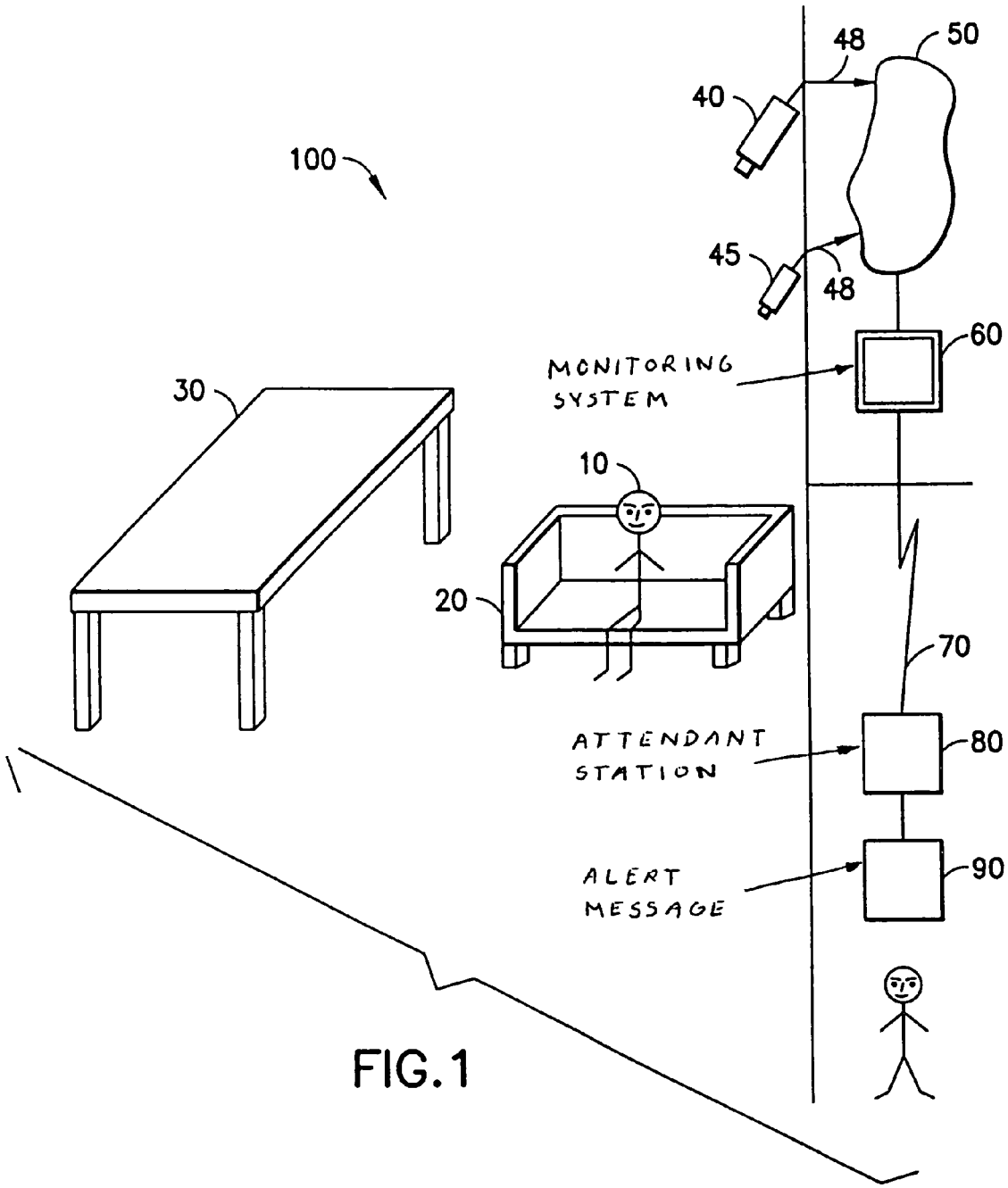
FIG. 1 is a block diagram on one preferred embodiment of the system.

FIG. 1 shows the elements of the system 100 used to monitor people. In FIG. 1, an at-risk individual 10 is in a home environment. The individual can be any human, including an old, young, or infirm person. This home environment can include a residence, an apartment, an assisted living facility, a condominium, a nursing home, and a retirement community. In a preferred embodiment, the system enables a monitoring service to be provided to at risk individuals.

The individual 10, is seated, e.g., on a couch 20 or near a table 30. An activity pickup 40 is present in the room. Activity pickup 40 in this example is a video camera which can record video and audio inputs. Another activity pickup, activity pickup 45 is present nearby. Activity pickup 45 is an audio pickup, with finer detection capability than activity pickup 40. The novel system can operate with a single activity pickup 40 or with multiple activity pickups (40, 45). Both activity pickup 40 and activity pickup 45 provide information outputs 48, which are communicated over a network 50 to a monitoring system 60. The monitoring system 60 determines when the information output 48 from any of activity pickup 40 and activity pickup 45 indicates a level of inactivity which is of concern. When this determined level of inactivity matches or exceeds a threshold, an alert is sent over network 70 to an attendant station 80. At station 80, an alert message 90 is displayed to an attendant.

Figure 2:
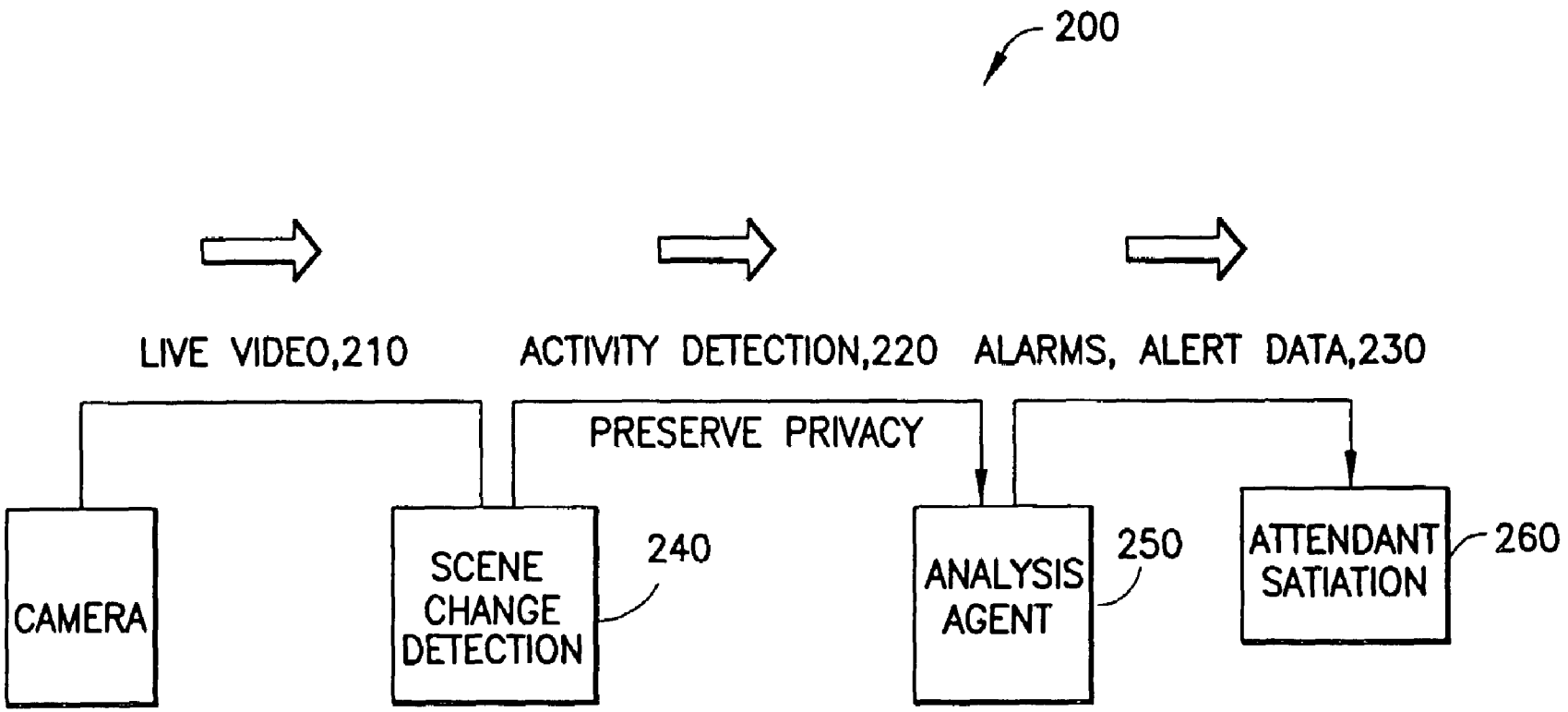
FIG. 2 is a flow chart of an information flow.

FIG. 2 shows the three information flows 200 for the system depicted in FIG. 1.

In this figure, the first flow is provided by the video camera (e.g., the activity pickup 40 of FIG. 1), which outputs live video 210 as information output 48. This live video 210 may be compressed, or left uncompressed. It is transmitted via wireline, or wireless network to a system 240 which analyzes the scenes, and detects when the scenes change.

The second flow is an activity detection flow 220. The scene change detector agent 240 determines the number of changes of scene, and optionally the magnitude of the changes. This is then passed, as an activity detection flow 220, to an analysis agent 250. The scene detection agent 240 also may detect significant changes in audio level, and relays the number of audio changes. The activity flow may also indicate periods of no change of activity. The activity detection flow 220 preserves the privacy of the individual 10, since no video scenes are passed, merely a measure of the activity depicted in the video scenes. In addition the scene change detector 240 can provide media analysis such as voice recognition, speaker identification, face identification, face recognition and facial expression identification. The activity flow 220 may also contain indicators resulting from this analysis, and interpreted data such as speaker identifications and facial expressions identified. The flow may also contain identification data on the activity pickups creating the flows. No primary data is transmitted in this information flow. Scene change detection 240 is well known.

The third flow 230 is from the analysis agent 250 to an attendant station 260. The analysis agent 250 may run in the same computer system, or a different computer system as the scene change detection process. The analysis agent 250 examines the activity detection data 220, and algorithmically relates it to alerting thresholds. The agent 250 may use rules, criteria, algorithms, or thresholds in this analysis. The analysis agent determines if an alert is to be transmitted to an attendant station. The alerts and alarm data form the third flow 230. This data is sent to the attendant station 260, where it is used to provide audio and visual alerts, alarms and supplementary data. The analysis agent 250 and the scene detection agent 240 may be operated on a single computer system, or may be operated on separate computer systems.

Figure 3A:
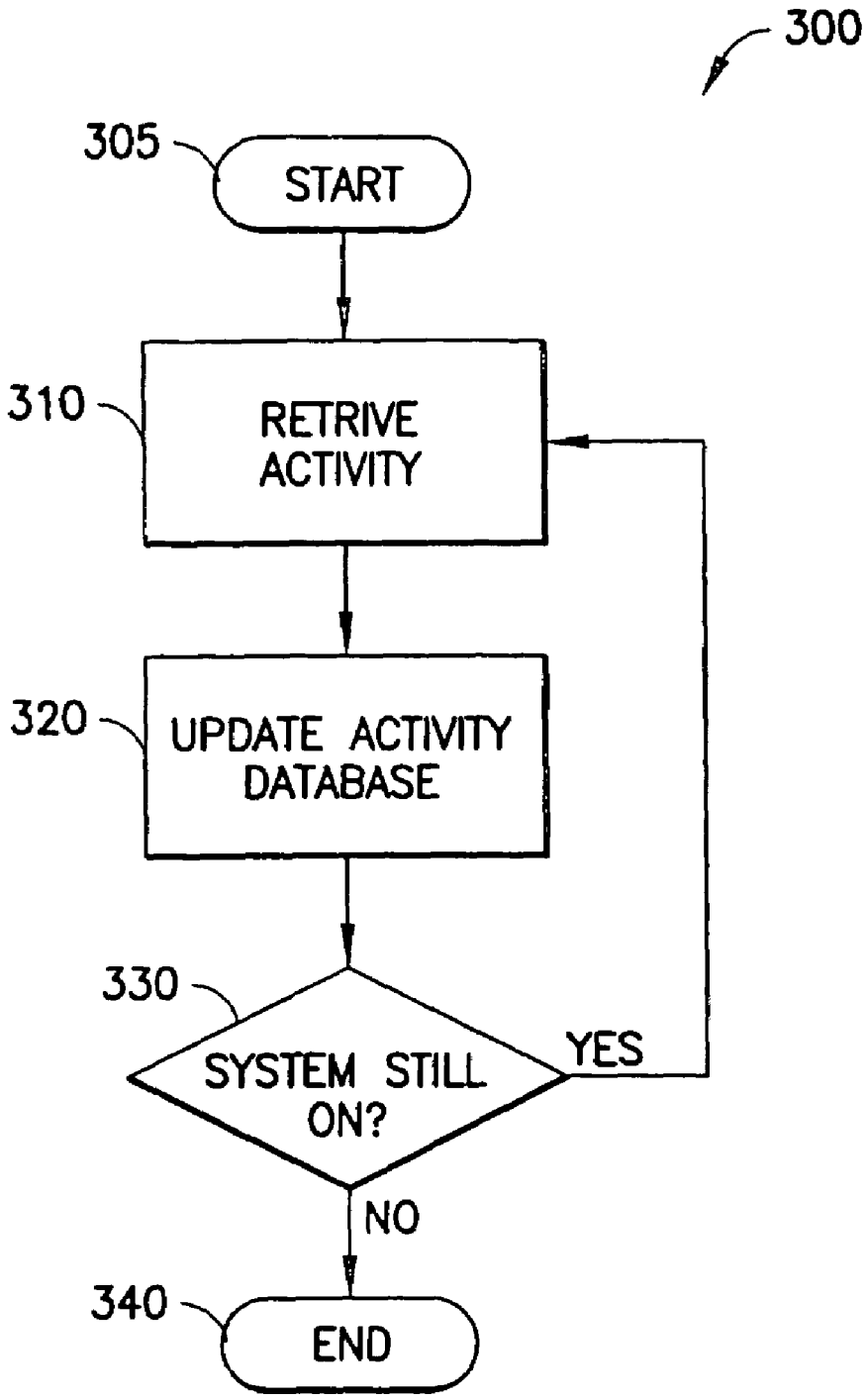
FIG. 3A is a flow chart of change detection process.
Figure 5:
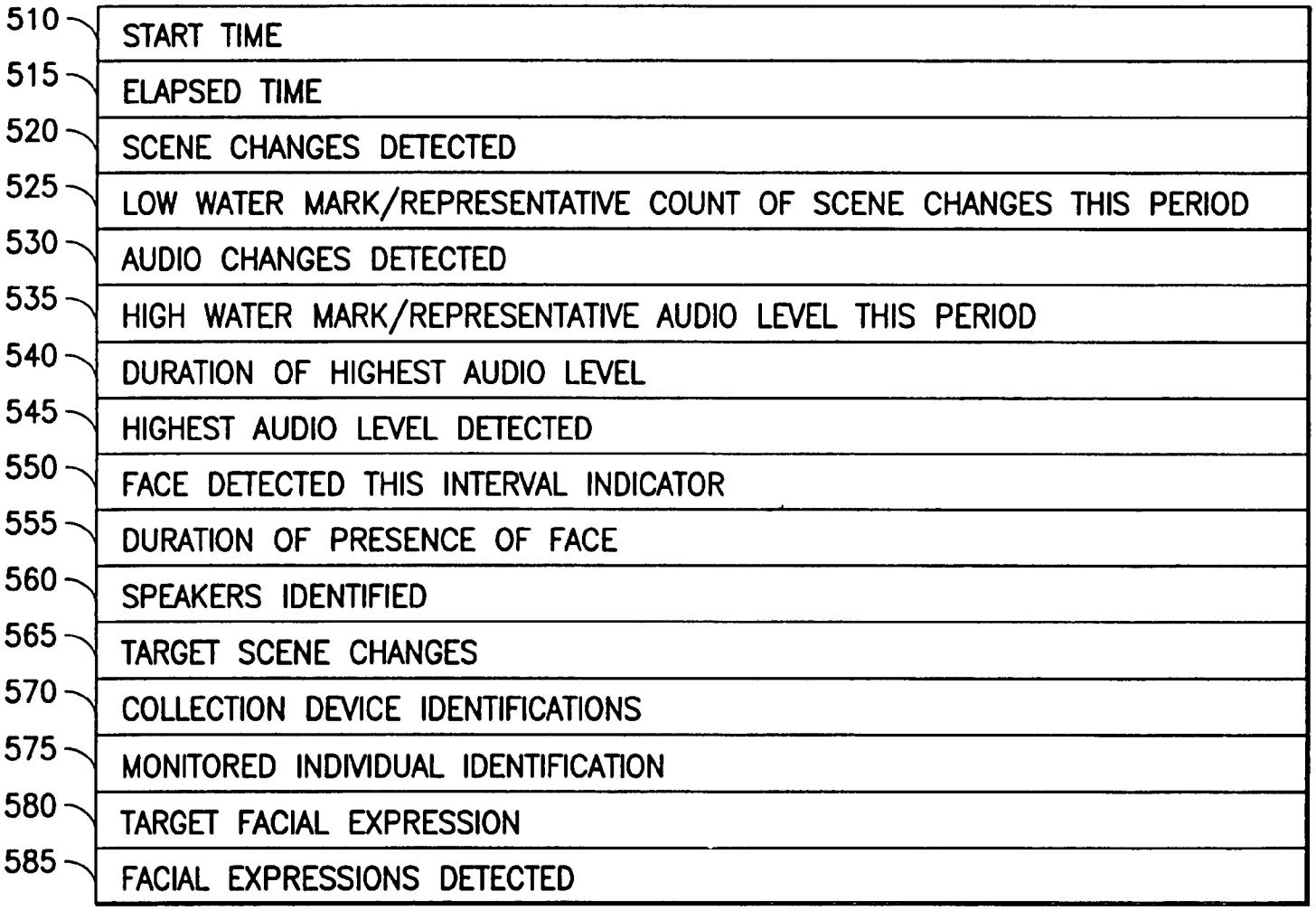
FIG. 5 is an example of an activity data base entry schema.

FIG. 3A depicts a data intake flow 300 in the analysis agent 250. In block 305 we begin, and in block 310, the system retrieves activity information. This activity information comes from the scene detection agent 240 of FIG. 2. In block 320, we update an activity database. This may be done on a periodic basis, or may represent the logging of all activity records as they are created by the scene change detector. FIG. 5 describes an example of such a data base entry. We check on system activity in block 330. If the system is active, that is, if activity records are being produced by the scene detection agent 240, we return to block 310 and continue to retrieve activity. If the system is no longer active, the process ends, at 340. The database thus represents the most recent information on the individual being monitored.

Figure 3B:
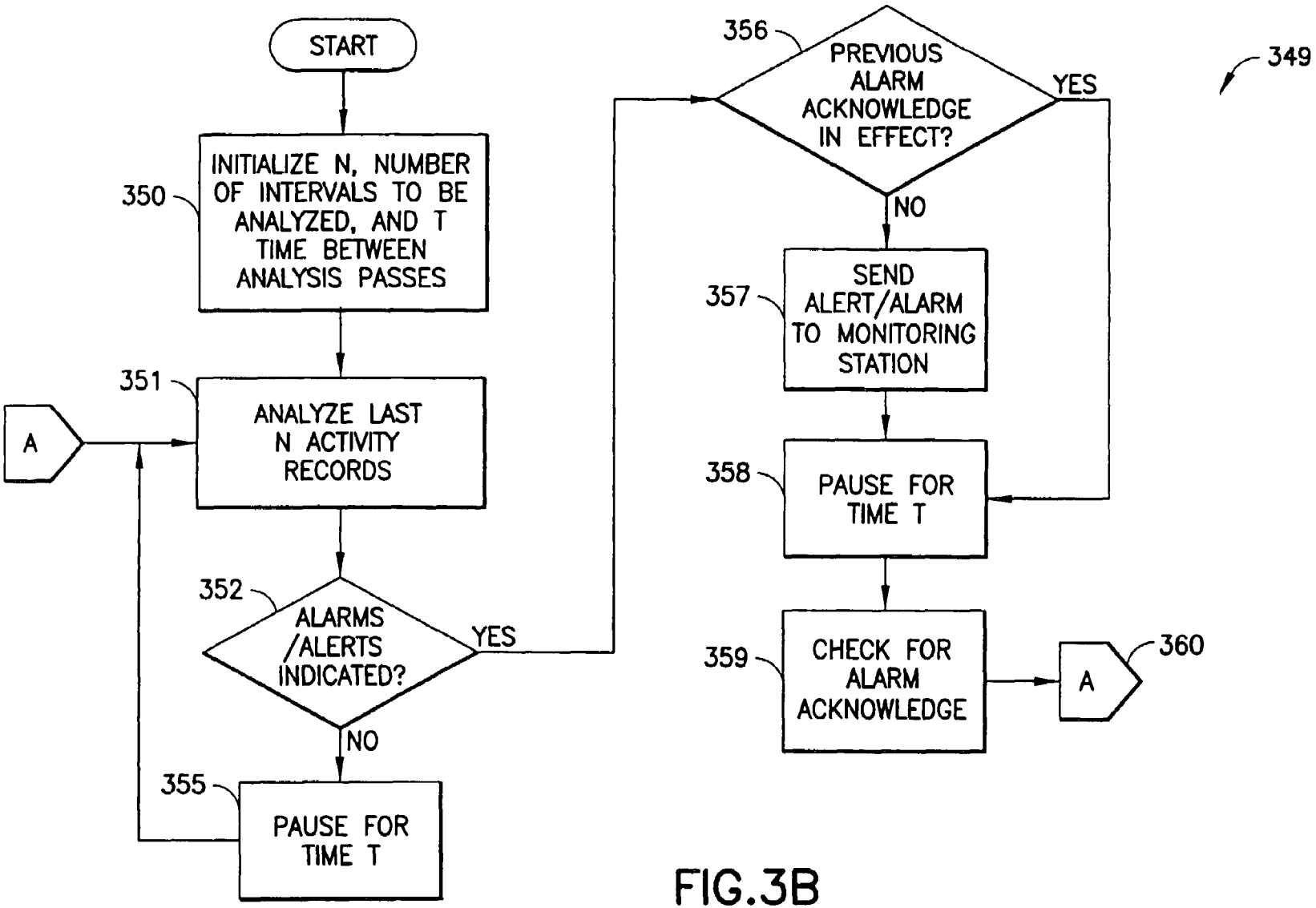
FIG. 3B is a flow chart of a analysis of activity process.
Figures 1, 3C:
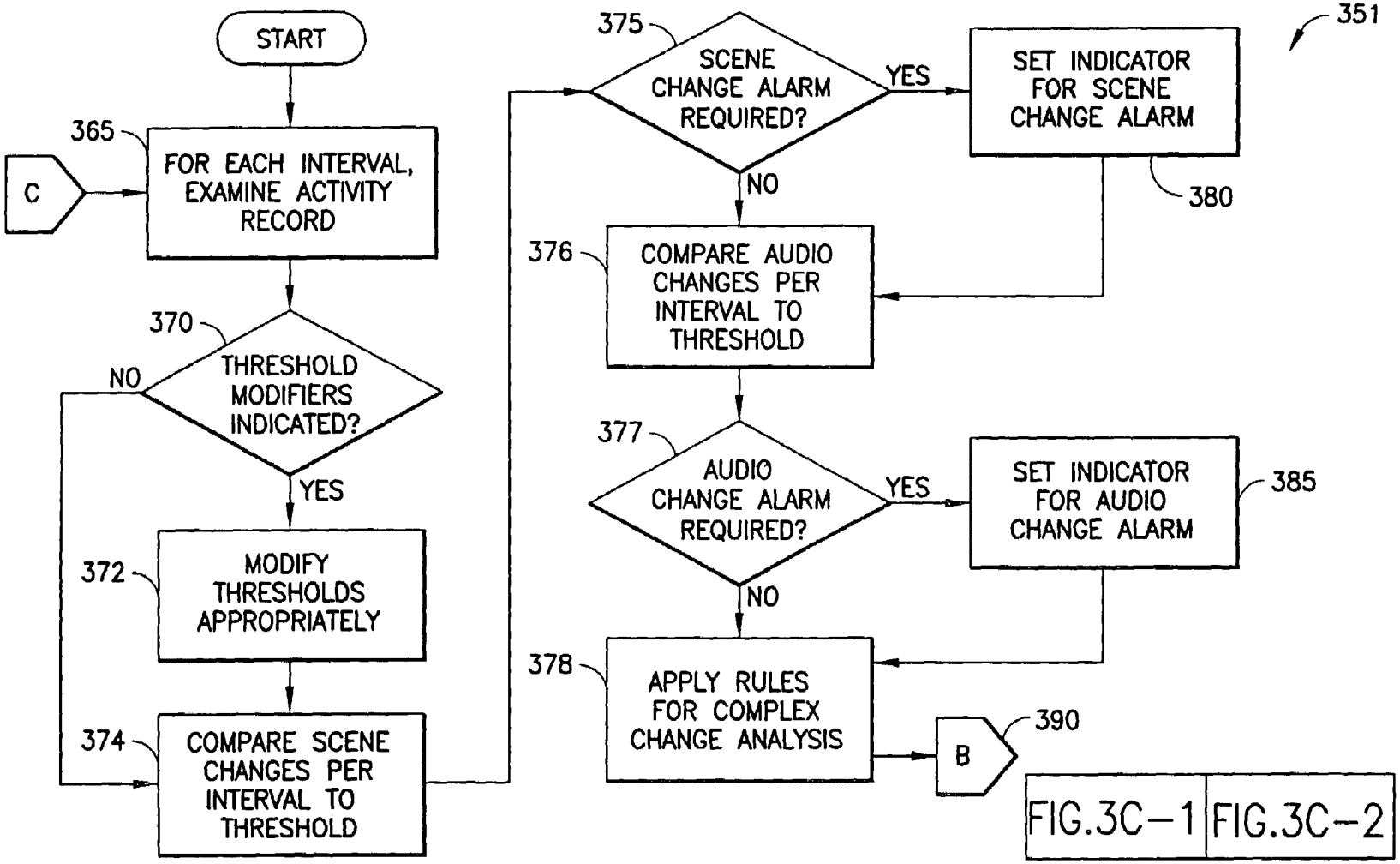
FIG. 3C is an analysis of last N activity records process.
Figures 2, 3C:
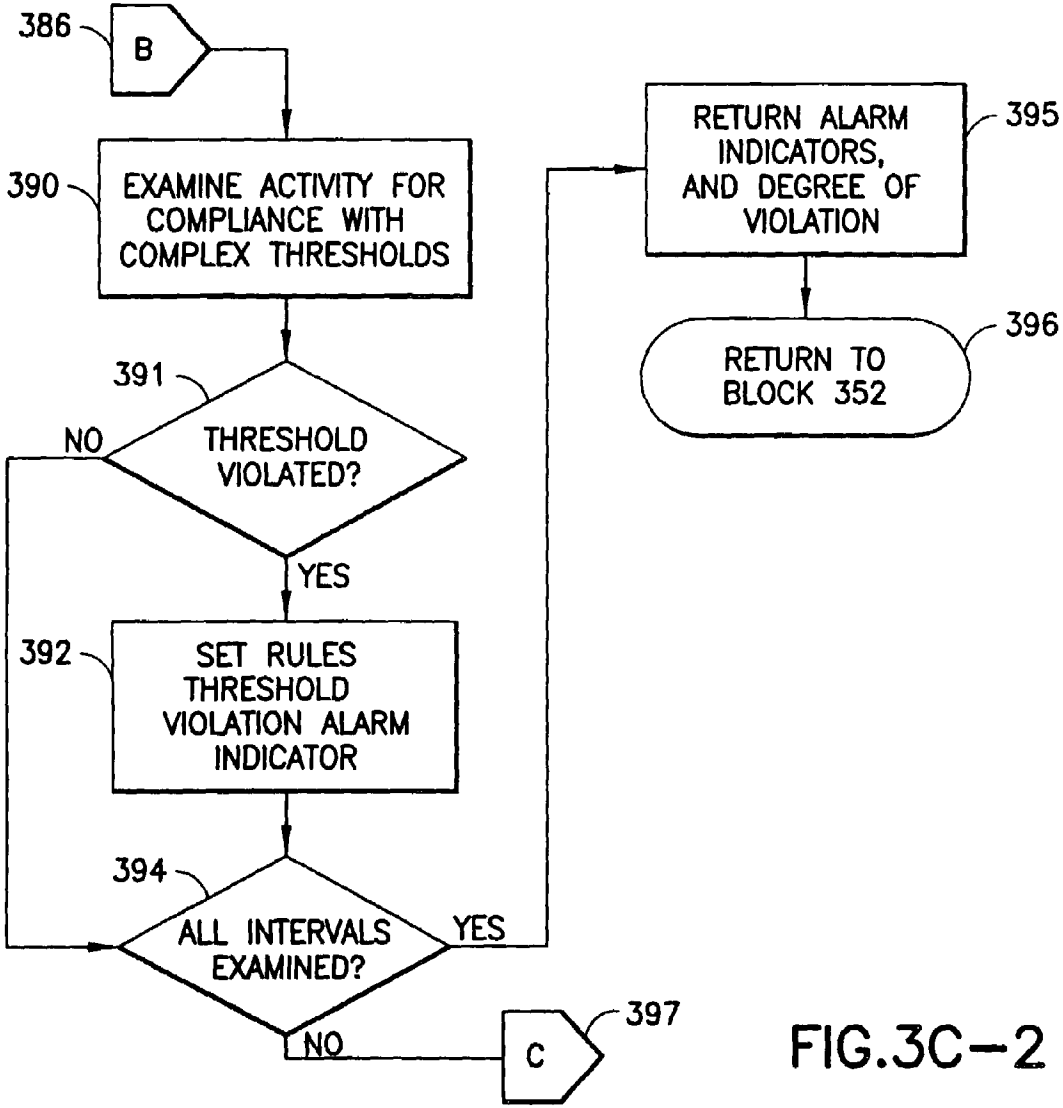

FIG. 3B is an example of an analysis process 349 in the analysis agent. In block 350, a number of activity intervals N, to be examined is established, as well as a time T to pause between analysis passes. We retrieve and analyze the N most recent activity records in block 351. This analysis may include comparing to a predetermined threshold, using a rules based system to evaluate inactivity, using an individual history as comparison data and other techniques. FIG. 3C provides a detailed view of the analysis summarized in block 351.

In block 352 we use the results of the analysis of the previous block to determine whether alarms or alerts should be given. If the answer is yes, then in block 356 we check to see if the alarms have been previously acknowledged by the monitoring station. If the answer is no, in block 357 we send the indicated alarms or alerts to the monitoring station and proceed to block 358. If the results of the check in block 356 was yes, that the alarms had been acknowledged, we proceed to block 358. In block 358, we pause for the previously established time T. In block 359 we check whether the monitoring station has acknowledged the alarm. In block 360, we return to monitoring at block 351.

If the result of block 352 was that no alarm or alert was indicated, in block 355, we then pause for time T, and return to block 351 to recommence the analysis.

FIG. 3C shows detail of the analysis in Block 351. To perform the analysis, we begin in block 365 by examining the activity record associated with each interval. In Block 370 we determine whether the standard comparison thresholds need be modified. Such modifications may be based on time of day, perceived health of the monitored individual, notification of a doctor's appointment, or other deduced or entered criteria. If the modifications are required, in block 372 we modify the comparison thresholds appropriately. If the modifications are not required, we proceed to block 374 directly from block 370. In block 374 we compare the scene changes detected in the interval to the comparison threshold. In block 375 we determine if a scene change alarm is required. This may be due to low or no detected changes, or excessive changes. If the test in block 375 yields a decision that an alarm is required, then in block 380 we set an indicator for the scene change alarm, and proceed to block 376. If the test in block 375 yields the decision that no scene change alarm is required we proceed directly to block 376. In block 376 we compare the audio changes detected in the interval to the comparison threshold. In block 377 we determine if the audio change alarm is required. If the result of the test in block 377 is that an alarm is required, in block 385 we set the indicator for the alarm, and proceed to block 378. If the result of the test in block 377 was that no alarm was required, we proceed directly to block 378. In block 378 we apply the rules for complex change analysis, and proceed in block 390 to the area indicated by the connector "B". Connector "B" takes us to block 386, which continues the detail of the analysis.

Continuing with block 386 leads to block 390. In Block 390 we examine the activity in the interval for compliance with complex thresholds based on the rules applied in block 378. Examples of such rules are: 1) increase the threshold for activity changes if there is a face in the room, and the hours are between 7AM and 10PM. 2) If the hour of the day is after midnight, the maximum audio level should be consistent with no TV or radio output. As is obvious to one skilled in the art, the complexity of these tests may be great depending on the rules which have been instantiated. In block 391 we determine if these complex thresholds have been violated, and if the answer is yes then in block 392 we set an indicator for the rules threshold alarm. If the answer was that the complex thresholds have not been violated, then we proceed directly to block 394. In block 394 we test to see if all intervals have been examined as required. If the result of the test is that they have not, we proceed to block 397, represented by connector "C". Connector C takes us to block 365 on FIG. 3C so that we can continue to examine the data for the remainder of the intervals in question. If the result of the test in block 394 yields the information that all the intervals have been examined, then we proceed to block 395, and return the indicators of alarms, and the degree to which the thresholds have been violated. In block 396 we complete this subprocess, and return to the mainline of description, starting with block 352 in FIG. 3B.

Figure 4:
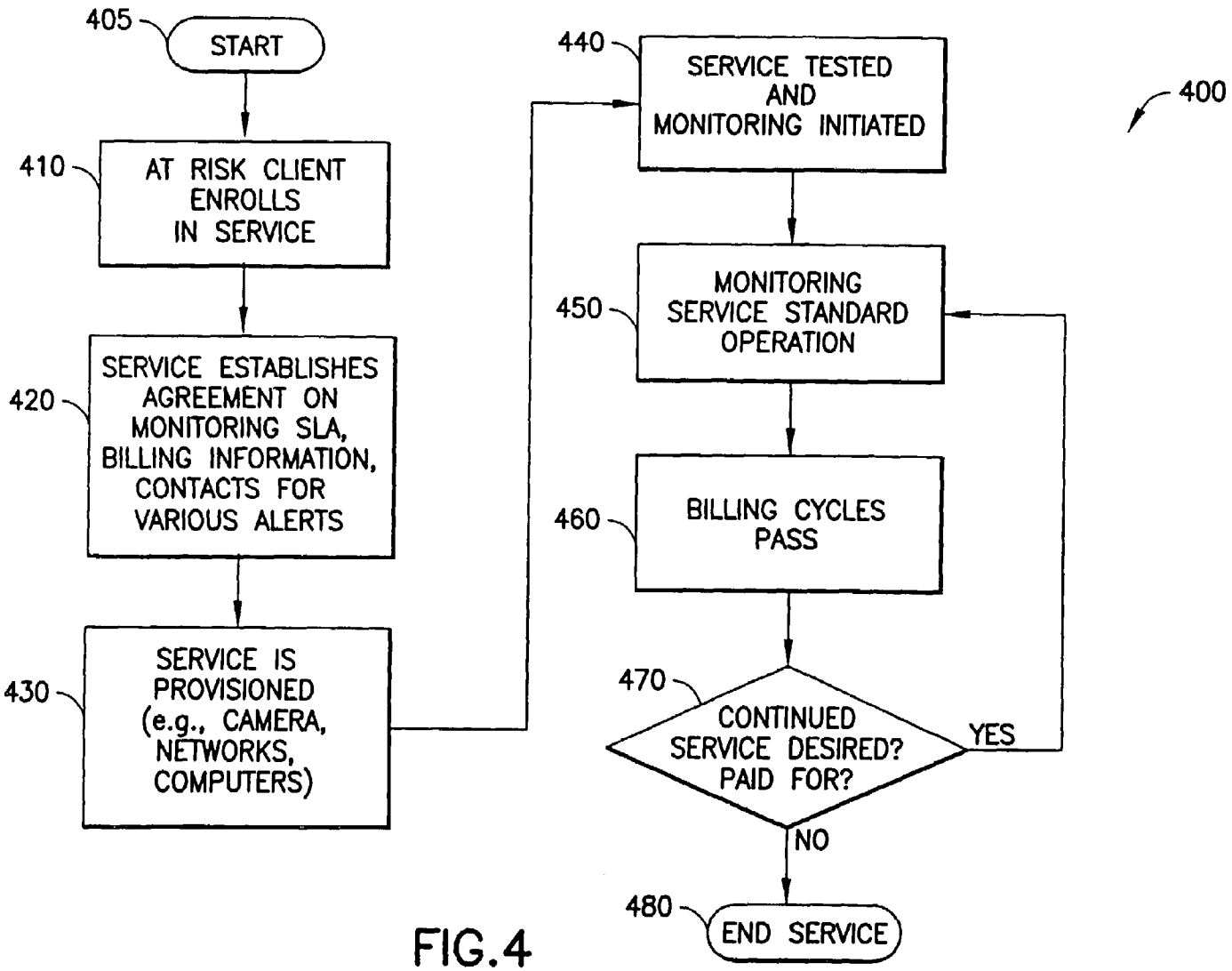
FIG. 4 is a flow chart of a customer life cycle.

FIG. 4 shows an example of the customer life cycle 400. We begin in block 405. In block 410 the at risk individual enrolls in the service. In block 420, service parameters are established for the individual, such as service level agreements, billing information, who to contact if various alerts are received and so on. Note that this may be accomplished by user specification, or may be offered on a class of service basis. That is, the service may provide several classes or level of service, such as 24×7 monitoring, monitoring only for lack of movement etc. and the individual may elect to purchase one of these classes of service. Alternatively, an agreement may be made which specifies specific service levels. In block 430 we continue, with the service being provisioned. This may include installation of cameras, networks, computer systems. In an alternate embodiment, these devices may already be present. For example, the individual may have moved into a facility advertising the availability of such monitoring service. In block 440, the service is tested and monitoring is initiated. Block 450 shows steady state delivery of the service. In block 460 billing cycles pass, and payment is expected., In block 470 we test to see if the service is to be continued and whether appropriate payment been received. If the service is to continue we return to block 450, steady state operation. If the service is to end, we terminate the service in block 480.

FIG. 5 shows an example activity database entry of the kind prepared in FIG. 3A. In block 510 we post the start time of the interval, and in block 515 we post the elapsed time. Block 520 records the number of scene changes detected in this period. Block 525 posts the low water mark and/or a representative count based on the historical record on this monitored individual of scene changes detected during this interval. That is, records for this time of day and day of week may have been examined, and the lowest scene change count, or a representative scene change count may be recorded here. In block 530 we find the number of audio volume changes detected in this period. In block 535 we find a high water mark or a representative count based on the historical record on this monitored individual of scene changes detected during this interval. That is, records for this time of day and day of week may have been examined, and the lowest audio volume change count, or a representative audio volume change count may be recorded here. In Block 540 we find the duration of the highest audio level detected during the period. If a TV or radio has been on "high", this may be uniformly loud. Block 545 is the highest audio level detected this period. In block 550, is an indicator as to whether a face has been detected during this period. This indicator can be used to modify thresholds. Block 555 records the duration of the period within the interval during which a face has been identified. Block 560 is a notation of the speakers who have been identified via speaker identification techniques. Block 565 contains the target number of scene changes. This can be used to assess activity level over time, as a response to physical therapy for example, or response to antidepressants. Block 570 carries the identifications of the collection devices. This is used for maintenance, and also to obtain primary level activity feeds (e.g. full video) in the event that it is necessary. Block 575 contains the identification of the individual being monitored. Block 580 contains a target facial expression, such as a grimace, which can be used to assess pain or distress. Block 585 carries indicators of the facial expressions detected.

As will be appreciated by one of skill in the art, embodiments of the present invention may be provided as methods, systems, or computer program products. Accordingly, the present invention may take the form of an entirely hardware embodiment, an entirely software embodiment or an embodiment combining software and hardware aspects. Furthermore, the present invention may take the form of a computer program product which is embodied on one or more computer-usable storage media (including, but not limited to, disk storage, CD-ROM, optical storage, and so forth) having computer-usable program code embodied therein.

The present invention has been described with reference to flowchart illustrations and/or flow diagrams of methods, apparatus (systems) and computer program products according to embodiments of the invention. It will be understood that each block of the flowchart illustrations and/or flow diagrams, and combinations of blocks in the flowchart illustrations and/or flows in the flow diagrams, can be implemented by computer program instructions. These computer program instructions may be provided to a processor of a general purpose computer, special purpose computer, embedded processor or other programmable data processing apparatus to produce a machine, such that the instructions, which execute via the processor of the computer or other programmable data processing apparatus, create means for implementing the functions specified in the flowchart and/or flow diagram block(s) or flow(s).

These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flowchart and/or flow diagram block(s) or flow(s).

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart and/or flow diagram block(s) or flow(s). Furthermore, the instructions may be executed by more than one computer or data processing apparatus.

While the preferred embodiments of the present invention have been described, additional variations and modifications in those embodiments may occur to those skilled in the art once they learn of the basic inventive concepts. Therefore, it is intended that the appended claims shall be construed to include both the preferred embodiments and all such variations and modifications as fall within the spirit and scope of the invention.

We claim:

1. A method of doing business providing a service of monitoring one or more humans comprising the steps of:

receiving information outputs from one or more activity pickups;

monitoring the information outputs;

processing the information outputs to be indicative of activity depicted in video scenes, without providing information which violates privacy of the one or more humans, by passing no video scenes; and determining when one or more types of inactivity of the human in an area exceeds one or more thresholds of inactivity and causes one or more alerts when one or more of the thresholds of inactivity is exceeded.

2. A method, as in claim 1, that is performed as a part of a contract for a human residence.

3. A method, as in claim 2, where the residence includes any one or more of the following: a house, an apartment, an assisted living facility, a condominium, a nursing home, and a retirement community.

4. A method, as in claim 2, further comprising the step of marketing the service to at risk individuals.

5. A method, as in claim 4, where the at risk individuals include any one or more of the following: the aged, the infirm, and the young.

6. A method, as in claim 2, further comprising the step of:

providing assistance to the human when one or more of the thresholds of inactivity are exceeded.

7. A method, as in claim 6, wherein the assistance includes: medical assistance, nursing assistance, and ambulance assistance.

8. A method, as in claim 1, further comprising:

updating an activity database with entries indicative of a start time of a monitoring interval, elapsed time from said start time, a number of scene changes detected in the monitoring interval, a low water mark of activity, a representative count based on an historical record on a monitored individual of scene changes detected during the interval, a number of audio volume changes detected in the interval, a high water mark or a representative count based on an historical record on the monitored individual of scene changes detected during the interval, a duration of the highest audio level detected during the interval, a highest audio level detected during the interval, an indicator as to whether a face has been detected during the interval, a duration of a period within the interval during which a face has been identified, a notation of speakers who have been identified via speaker identification techniques, a target number of scene changes, identifications of said activity pickups, an identification of an individual being monitored, a target facial expression, and indicators of facial expressions detected; and using said database to modify said one or more thresholds of inactivity.

9. A method of doing business providing a service of monitoring one or more humans comprising the steps of:

receiving information outputs from one or more activity pickups;

monitoring the information outputs;

determining when one or more types of inactivity of the human in an area exceeds one or more thresholds of inactivity and causes one or more alerts when one or more of the thresholds of inactivity is exceeded;

updating an activity database with entries indicative of a start time of a monitoring interval, elapsed time from said start time, a number of scene changes detected in the monitoring interval, a low water mark of activity, a representative count based on an historical record on a monitored individual of scene changes detected during the interval, a number of audio volume changes detected in the interval, a high water mark or a representative count based on an historical record on the monitored individual of scene changes detected during the interval, a duration of the highest audio level detected during the interval, a highest audio level detected during the interval, an indicator as to whether a face has been detected during the interval, a duration of a period within the interval during which a face has been identified, a notation of speakers who have been identified via speaker identification techniques, a target number of scene changes, identifications of said activity pickups, an identification of an individual being monitored, a target facial expression, and indicators of facial expressions detected; and using said database to modify said one or more thresholds of inactivity.

* * * * *